US005584403A

United States Patent [19]

Sipperly

[11] Patent Number: 5,584,403

[45] Date of Patent: Dec. 17, 1996

[54] UMBRELLA HOLDER

[76] Inventor: Andrew P. Sipperly, 91 Goose Hollow Rd., Greenfield Center, N.Y. 12833

[21] Appl. No.: 490,664

[22] Filed: Jun. 15, 1995

[51] Int. Cl.[6] ..... A47F 7/00

[52] U.S. Cl. ..... 211/63; 211/89; 248/205.2; 248/309.1; 224/915

[58] Field of Search ..... 211/62, 63, 60.1, 211/89; 248/205.2, 309.1; 224/915, 567

[56] References Cited

U.S. PATENT DOCUMENTS

| | | | |
|---|---|---|---|
| 792,126 | 6/1905 | Freund | 224/915 X |
| 913,188 | 2/1909 | Backus | 224/915 X |
| 1,406,097 | 2/1922 | Snickers | 211/63 |
| 3,273,769 | 9/1966 | Miller | 222/915 X |
| 3,351,251 | 11/1967 | Hinkle | 224/915 X |
| 4,009,854 | 3/1977 | Moyer | 211/63 X |
| 5,046,622 | 9/1991 | Wood | 224/915 X |
| 5,363,734 | 11/1994 | Wilenken | 248/309.1 X |

*Primary Examiner*—Robert W. Gibson, Jr.

[57] ABSTRACT

A holder for supporting an umbrella. The inventive device includes tip mounting assembly securable to a support surface for receiving a tip of a closed umbrella. A handle mounting assembly is securable to the support surface for receiving a handle of the umbrella to support the umbrella relative to the support surface for storage and drying of the umbrella.

3 Claims, 4 Drawing Sheets

PRIOR ART

Fig. 6
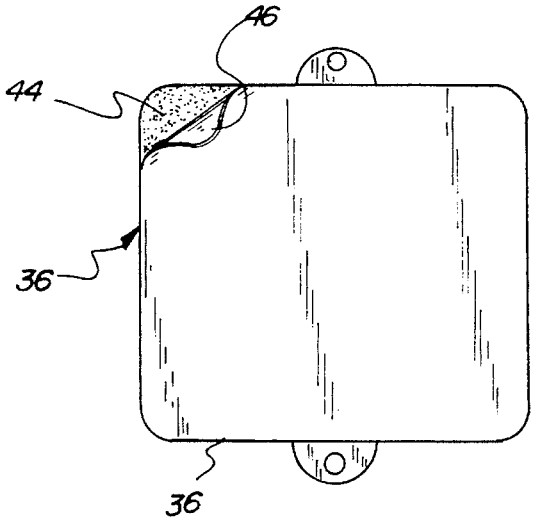
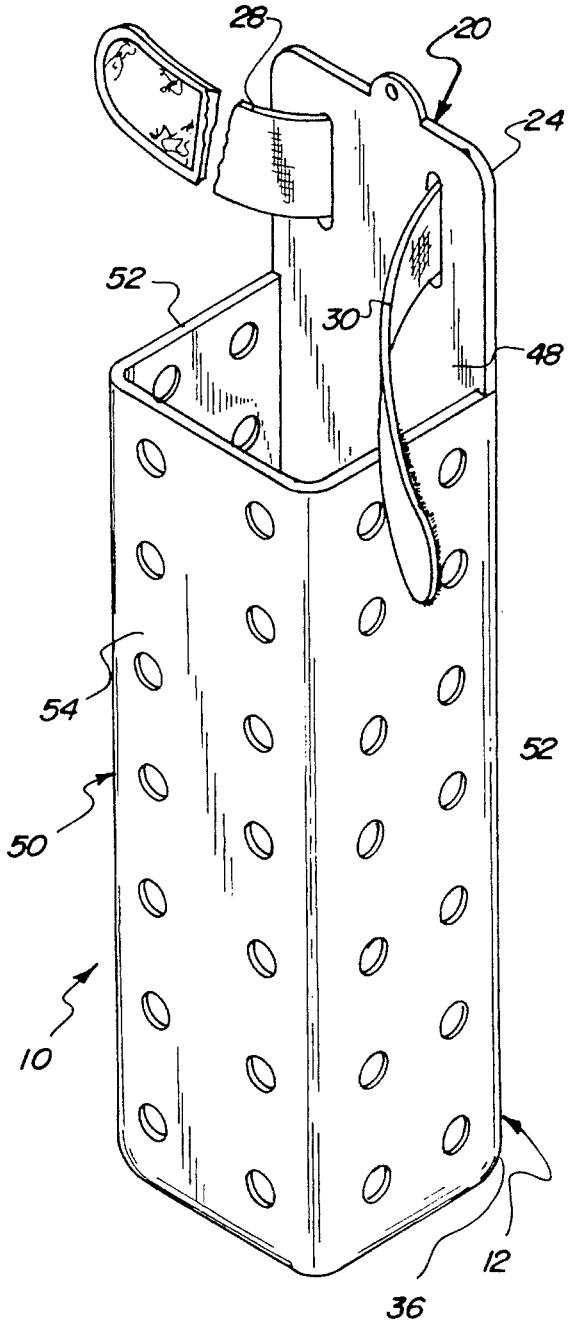
Fig. 7

UMBRELLA HOLDER

BACKGROUND OF THE INVENTION

1. Field of the Invention

The present invention relates to article holding devices and more particularly pertains to an umbrella holder for supporting an umbrella.

2. Description of the Prior Art

The use of article holding devices is known in the prior art. More specifically, article holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art article holding devices include U.S. Pat. Nos. 5,129,615; 4,700,848; 4,066,170; 3,700,149; U.S. Design Patent 308,442; and U.S. Design Patent 336,389.

While these devices fulfill their respective, particular objectives and requirements, the aforementioned patents do not disclose an umbrella holder for supporting an umbrella which includes a tip mounting assembly securable to a support surface for receiving a tip of a closed umbrella, and a handle mounting assembly securable to the support surface for receiving a handle of the umbrella to support the umbrella relative to the support surface for storage and drying of the umbrella.

In these respects, the umbrella holder according to the present invention substantially departs from the conventional concepts and designs of the prior art, and in so doing provides an apparatus primarily developed for the purpose of supporting an umbrella relative to a support surface.

SUMMARY OF THE INVENTION

In view of the foregoing disadvantages inherent in the known types of article holding devices now present in the prior art, the present invention provides a new umbrella holder construction wherein the same can be utilized for supporting an umbrella. As such, the general purpose of the present invention, which will be described subsequently in greater detail, is to provide a new umbrella holder apparatus and method which has many of the advantages of the article holding devices mentioned heretofore and many novel features that result in a umbrella holder which is not anticipated, rendered obvious, suggested, or even implied by any of the prior art article holding devices, either alone or in any combination thereof.

To attain this, the present invention generally comprises a holder for supporting an umbrella. The inventive device includes tip mounting assembly securable to a support surface for receiving a tip of a closed umbrella. A handle mounting assembly is securable to the support surface for receiving a handle of the umbrella to support the umbrella relative to the support surface for storage and drying of the umbrella.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new umbrella holder apparatus and method which has many of the advantages of the article holding devices mentioned heretofore and many novel features that result in a umbrella holder which is not anticipated, rendered obvious, suggested, or even implied by any of the prior art article holding devices, either alone or in any combination thereof.

It is another object of the present invention to provide a new umbrella holder which may be easily and efficiently manufactured and marketed.

It is a further object of the present invention to provide a new umbrella holder which is of a durable and reliable construction.

An even further object of the present invention is to provide a new umbrella holder which is susceptible of a low cost of manufacture with regard to both materials and labor, and which accordingly is then susceptible of low prices of sale to the consuming public, thereby making such umbrella holders economically available to the buying public.

Still yet another object of the present invention is to provide a new umbrella holder which provides in the apparatuses and methods of the prior art some of the advantages thereof, while simultaneously overcoming some of the disadvantages normally associated therewith.

Still another object of the present invention is to provide a new umbrella holder for supporting an umbrella relative to a support surface.

Yet another object of the present invention is to provide a new umbrella holder which includes a tip mounting assembly securable to a support surface for receiving a tip of a closed umbrella, and a handle mounting assembly securable to the support surface for receiving a handle of the umbrella to support the umbrella relative to the support surface for storage and drying of the umbrella.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a rear elevation view of the tip mounting means as viewed from line 6—6 of FIG. 3.

FIG. 7 is an isometric illustration of an alternative form of the present invention including an apertured enclosure.

DESCRIPTION OF THE PREFERRED EMBODIMENT

Figure 1:
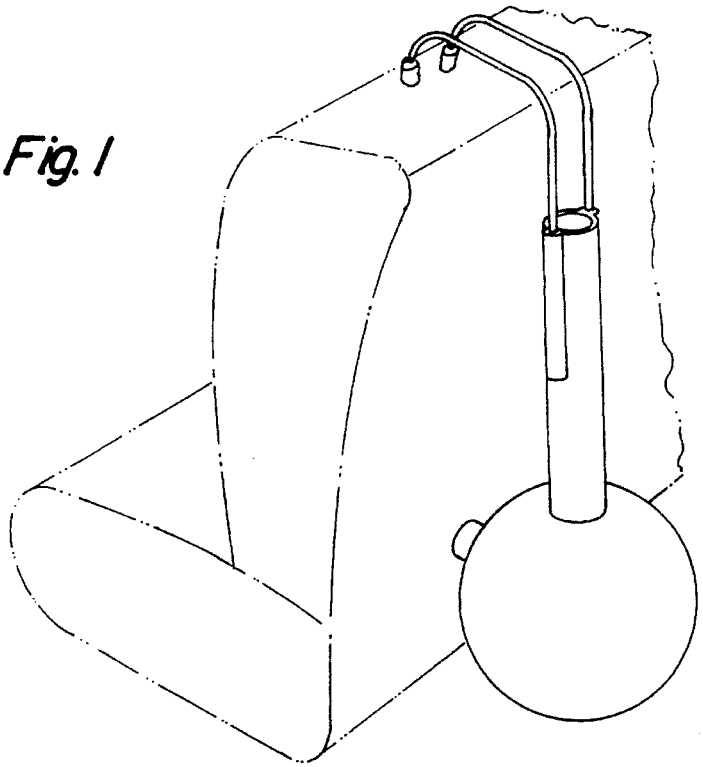
FIG. 1 is an isometric illustration of a prior art article holding device.

With reference now to the drawings, and in particular to FIGS. 3–9 thereof, a new umbrella holder embodying the principles and concepts of the present invention and generally designated by the reference numeral 10 will be described.

Figure 2:
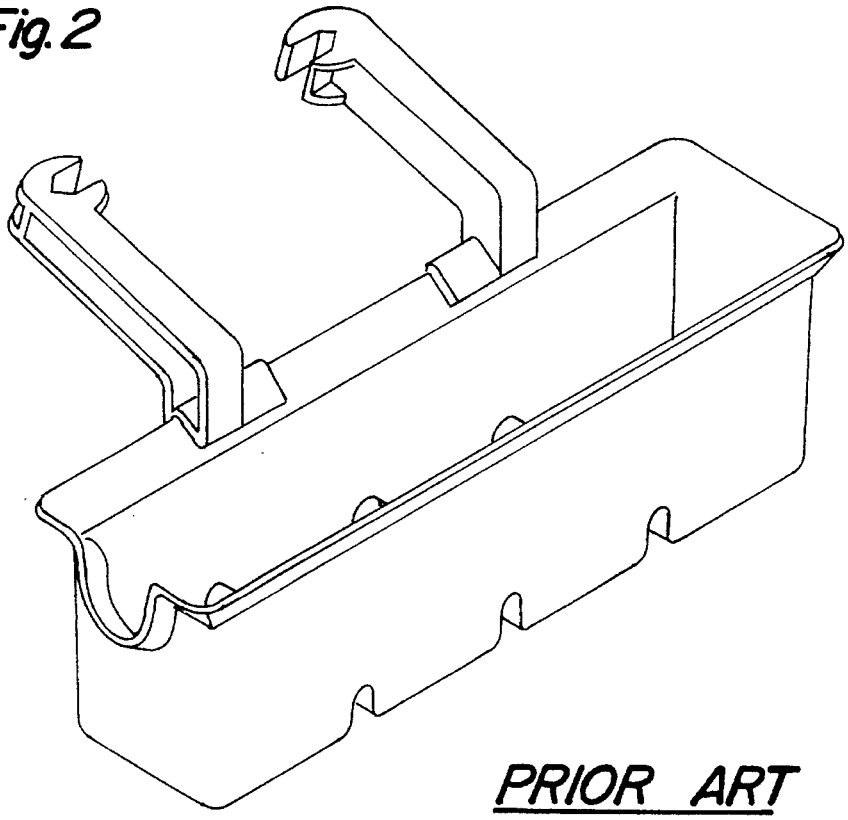
PRIOR ART Fig. 2
FIG. 2 is an isometric illustration of a further prior art holding device.

Referring initially to FIGS. 1 and 2 of the drawings wherein prior arts article holding devices are illustrated, it can be shown that the prior art teaches a container suspended from an automobile seat, as shown in FIG. 1, or alternatively teaches a trough-style tray for receiving an umbrella, as shown in FIG. 2 of the drawings.

Figure 3:
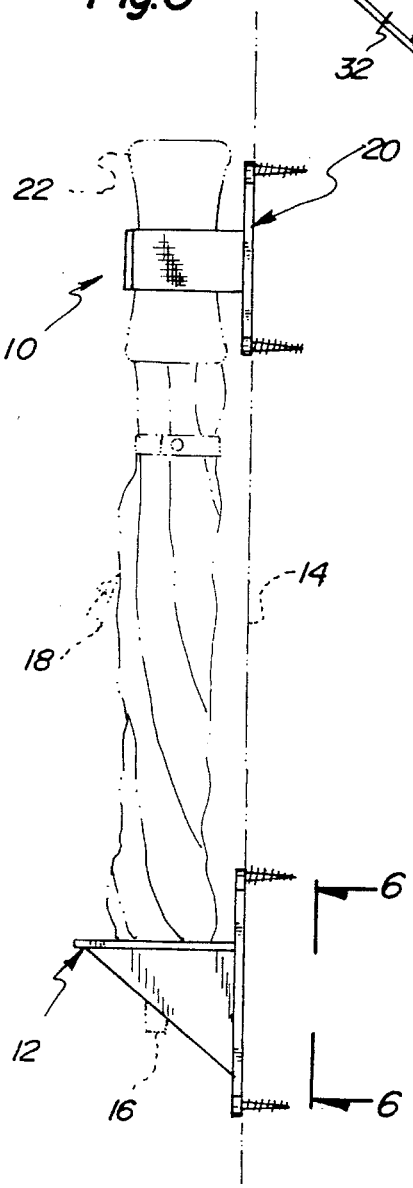
FIG. 3 is a side elevation view of an umbrella holder according to the present invention in use.

Turning now to FIGS. 3 through 9 wherein the present invention 10 is illustrated in detail, it can be shown that the umbrella holder 10 substantially departs from the designs and concepts of the prior art and comprises a tip mounting means 12 securable to a support surface 14 for receiving and supporting a tip 16 of an umbrella 18, as shown in FIG. 3 of the drawings. The present invention 10 further comprises a handle mounting means 20 securable to the support surface 14 for engaging and supporting a handle 22 of the umbrella 18. By this structure, the umbrella 18 can be releasably secured relative to the support surface 14 for storage and/or drying of the umbrella.

Figure 4:
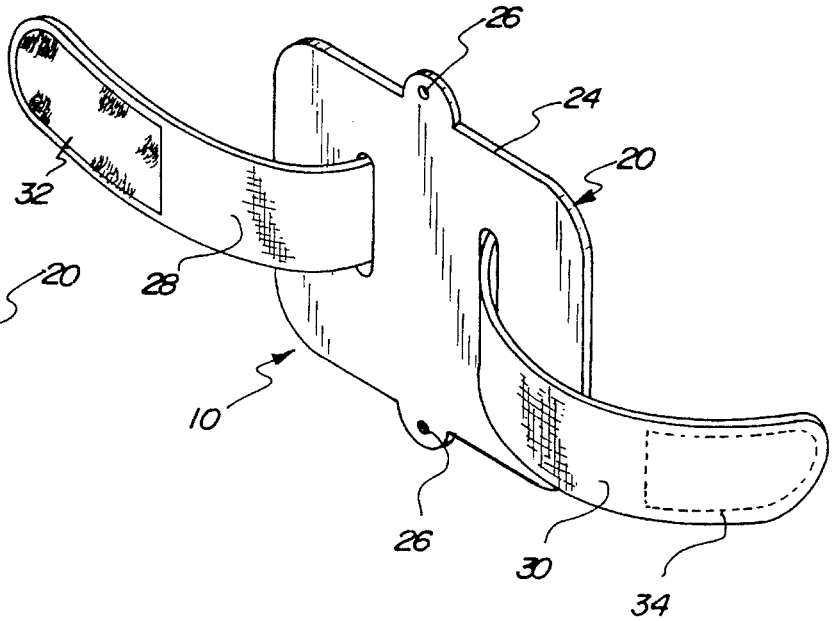
FIG. 4 is an isometric illustration of a handle mounting means comprising a portion of the present invention.

Referring now to FIG. 4 wherein the handle mounting means 20 is illustrated in detail, it can be shown that the handle mounting means comprises a handle mounting plate 24 having a plurality of mounting apertures 26 directed therethrough permitting the passage of threaded fasteners or the like through the mounting plate for securement into the support surface 14 as shown in FIG. 3. A first strap 28 extends from the handle mounting plate 24 and is cooperable with a second strap 30 so as to circumferentially extend about a handle 22 of an umbrella 18 as shown in FIG. 3. To permit releasable securement of the straps 28 and 30 together, a first portion 32 of a hook and loop fabric fastening material such as is commonly known under the trademarked name "VELCRO" is secured to a free end of the first strap 28. Similarly, a second portion 34 of hook and loop fabric fastening material is secured to a free end of the second strap 30 and cooperable with the first portion 32 of fabric fastening material of the first strap 28 so as to secure the straps 28 and 30 about the handle 22 as shown in FIG. 3.

Figure 5:
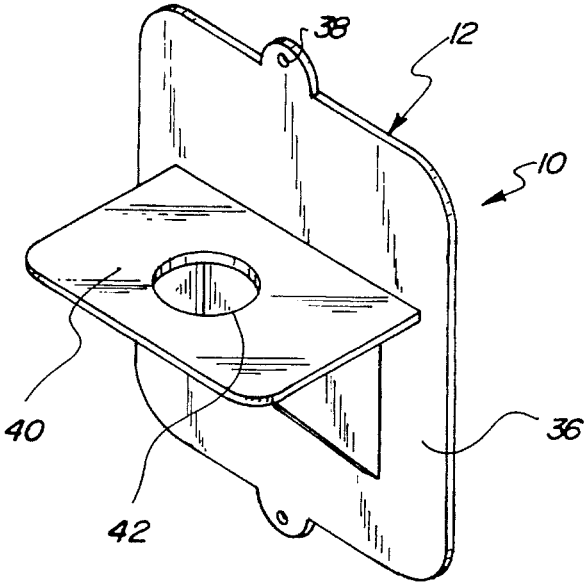
FIG. 5 is an isometric illustration of a tip mounting means comprising a further portion of the present invention.

Referring now to FIG. 5, it can be shown that the tip mounting means 12 preferably comprises a tip mounting plate 36 having at least one mounting aperture 38 directed therethrough permitting the direction of threaded fasteners or the like through the tip mounting plate and into the support surface 14 as shown in FIG. 3 of the drawings. A tip supporting plate 40 extends substantially orthogonally from the tip mounting plate 36 and includes a tip receiving aperture 42 through which the tip 16 of the umbrella 18 can be positioned. Preferably, the tip mounting plate 36 of the tip mounting means 12 is mounted in a spaced relationship relative to the handle mounting plate 24 of the handle mounting means 20 such that the tip 16 resides within the tip receiving aperture 42 when the handle 22 of the umbrella 18 is secured within the straps 28 and 30 of the handle mounting means 20. By this structure, the umbrella 18 can be supported in a spaced and substantially parallel orientation relative to the support surface 18 for drying and/or storage of the umbrella.

Referring now to FIG. 6, it can be shown that the tip mounting means 36, in addition to or in lieu of the mounting apertures 38 directed through the tip mounting plate 36, may further comprise an adhesive 44 applied to a rear surface of the tip mounting plate and covered by a removable backing 46. Further, it is to understood that the handle mounting plate 24 of the handle mounting means 20, in addition to or in lieu of the mounting apertures 26 directed through the mounting plate, may also comprise an adhesive applied to a rear surface of the handle mounting plate similarly covered by a removable backing 46. By this structure, the tip mounting means 12 and the handle mounting means 20 can be adhesively secured to the support surface 14 as desired.

Figure 8:
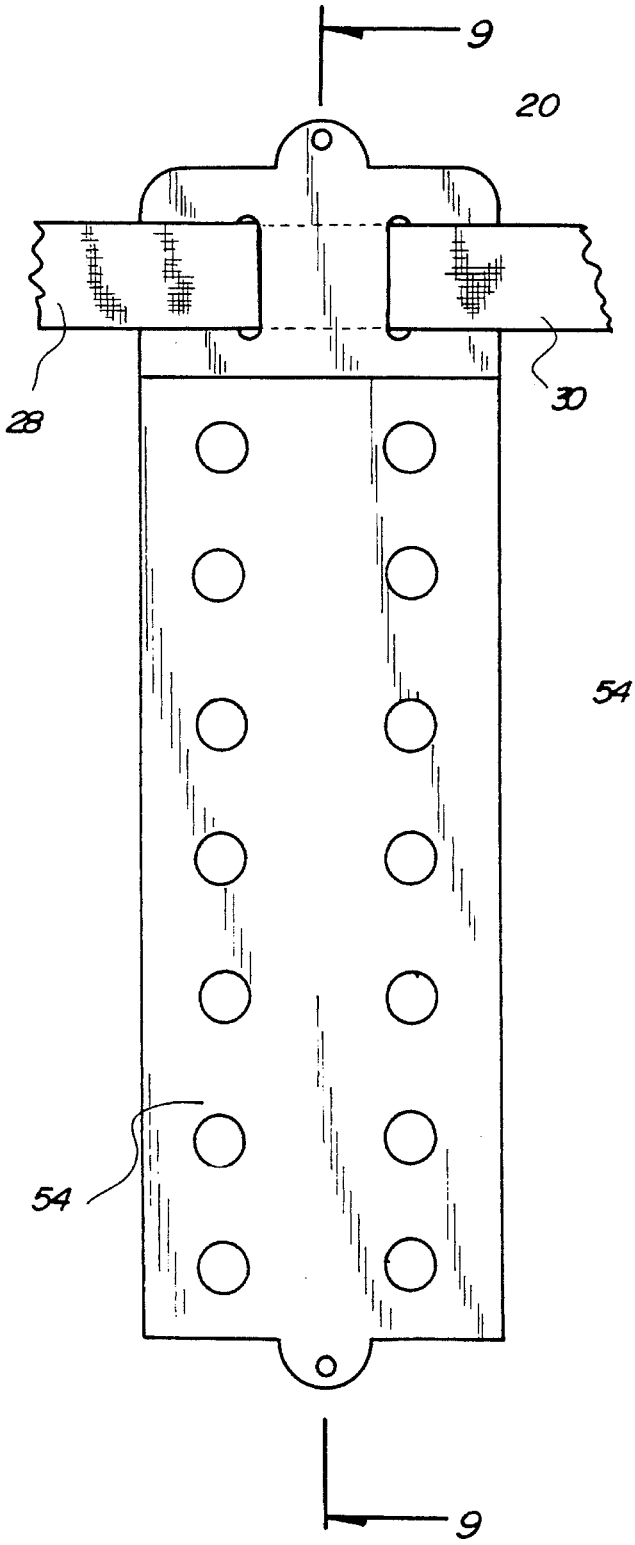
FIG. 8 is a front elevation view of the alternative form of the invention.
Figure 9:
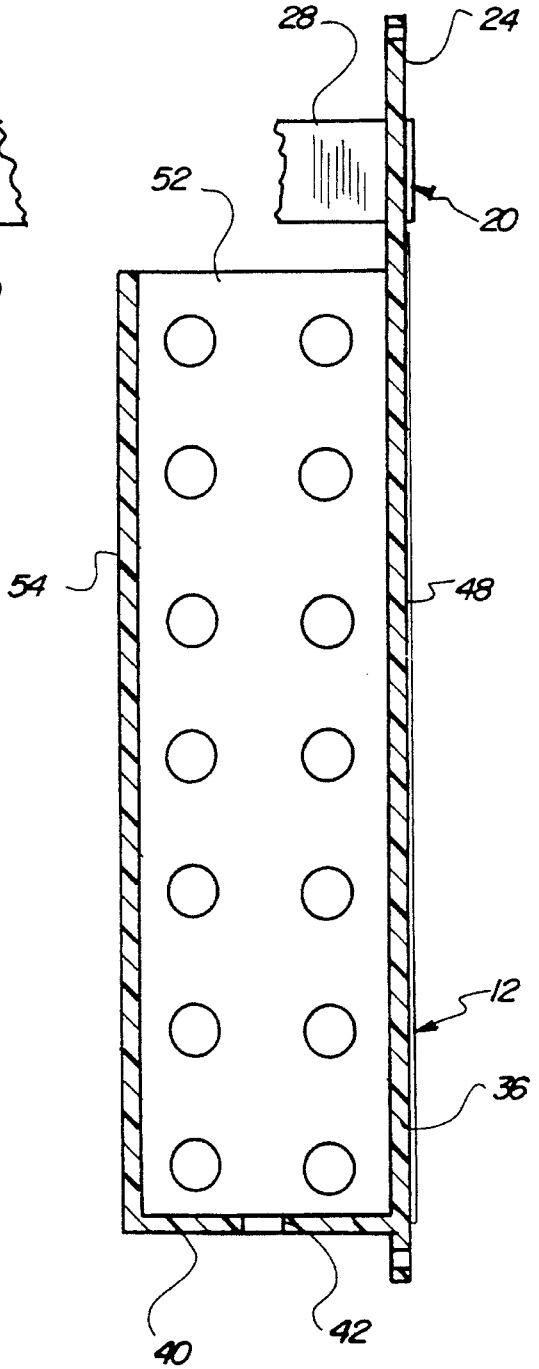
FIG. 9 is a cross sectional view taken along line 9—9 of FIG. 8.

Referring now to FIGS. 7 through 9 wherein an alternative form of the present invention 10 is illustrated in detail, it can be shown that the umbrella holder may further comprise a center plate 48 integrally or otherwise fixedly secured to and extending between the handle mounting plate 24 and the tip mounting plate 36 of the respective handle mounting means 20 and tip mounting means 12. Further, the alternative form of the present invention 10 additionally comprises an apertured enclosure 50 coupled to the center plate 48 and extending into contiguous communication with the tip supporting plate 40. The apertured enclosure 50 preferably comprises a pair of substantially spaced and parallel lateral walls 52 which orthogonally extend from respectively opposed sides of the center plate 48. A front wall 54 orthogonally extends between the lateral walls 52 and cooperates therewith to define the apertured enclosure 50. Preferably, the lateral walls 52 and the front wall 54 are each shaped so as to define a plurality of ventilation apertures directed therethrough which permit water or like fluids to evaporate from the umbrella 18 when positioned therewithin. By this structure, the apertured enclosure 50 serves to protectively enclose the umbrella 18 during storage thereof in conjunction with the present invention 10.

In use, the umbrella holder 10 according to the present invention can be easily utilized to effect removable mounting of an umbrella 18 relative to a support surface 14 within a vehicle or other structure. The present invention 10 can be secured to a support surface 14 in any desired orientation as permitted by the confines of the vehicle or other structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A umbrella holder comprising:

a tip mounting means securable to a support surface for receiving and supporting a tip of an umbrella, the tip mounting means comprising a tip mounting plate; a tip supporting plate extending from the tip mounting plate and including a tip receiving aperture through which a tip of an umbrella can be positioned;

a handle mounting means securable to the support surface for engaging and supporting a handle of the umbrella, the handle mounting means comprising a handle mounting plate; a first strap extending from the handle mounting plate; a second strap extending from the handle mounting plate and being cooperable with the first strap so as to circumferentially extend about a handle of an umbrella; a first portion of hook and loop fabric fastening material secured to a free end of the first strap; and a second portion of hook and loop fabric fastening material secured to a free end of the second strap, a center plate secured to an extending between the handle mounting plate and the tip mounting plate of the respective handle mounting means and tip mounting means, and an apertured enclosure coupled to the center plate and extending into contiguous communication with the tip supporting plate.

2. The umbrella holder of claim 1, wherein the apertured enclosure comprises a pair of substantially spaced and parallel lateral walls which extend from respectively opposed sides of the center plate; and a front wall extending between the lateral walls.

3. The umbrella holder of claim 2, wherein the lateral walls and the front wall are each shaped so as to define a plurality of ventilation apertures directed therethrough.

* * * * *